US010948881B2

(12) United States Patent
Born et al.

(10) Patent No.: US 10,948,881 B2
(45) Date of Patent: Mar. 16, 2021

(54) TIMEPIECE MOVEMENT FITTED WITH AN ELECTROMAGNETIC TRANSDUCER

(71) Applicant: The Swatch Group Research and Development Ltd, Marin (CH)

(72) Inventors: Jean-Jacques Born, Morges (CH); Yvan Ferri, Lausanne (CH)

(73) Assignee: The Swatch Group Research and Development Ltd, Marin (CH)

( * ) Notice: Subject to any disclaimer, the term of this patent is extended or adjusted under 35 U.S.C. 154(b) by 426 days.

(21) Appl. No.: 16/045,833

(22) Filed: Jul. 26, 2018

(65) Prior Publication Data

US 2019/0041805 A1 Feb. 7, 2019

(30) Foreign Application Priority Data

Aug. 4, 2017 (EP) ..... 17184880

(51) Int. Cl.
*G04C 3/16* (2006.01)
*G04C 3/06* (2006.01)

(52) U.S. Cl.
CPC ..... *G04C 3/16* (2013.01); *G04C 3/066* (2013.01)

(58) Field of Classification Search
CPC ..... G04C 3/16; G04C 3/165; G04C 3/066
See application file for complete search history.

(56) References Cited

U.S. PATENT DOCUMENTS 2,986,686 A * 5/1961 Clifford ..... H02K 29/12 318/400.01
3,161,012 A * 12/1964 Hug ..... G04C 3/06 368/169
3,796,039 A * 3/1974 Lucien ..... G04C 13/11 368/155

(Continued)

FOREIGN PATENT DOCUMENTS

CH 701 329 A2 12/2010
EP 1 109 082 A1 6/2001
EP 1 237 058 A1 9/2002

OTHER PUBLICATIONS

European Search Report dated Feb. 5, 2018 in European Application 17184880.7 filed on Aug. 4, 2017 (with English Translation of Categories of Cited Documents).

*Primary Examiner* — Sean Kayes
(74) *Attorney, Agent, or Firm* — Oblon, McClelland, Maier & Neustadt, L.L.P.

(57) ABSTRACT

Timepiece movement fitted with an electromagnetic transducer comprising at least one coil and a rotor formed of a central shaft, of two magnetic plates that are mounted on the central shaft and of a plurality of bipolar magnets which are axially polarized and mounted on at least one of the two magnetic plates, said at least one coil penetrating at least partially into a circular space which is defined by the rotor between its two magnetic plates and left free by this rotor. The central shaft comprises a pinion which engages with a wheel of the timepiece movement, this pinion being arranged between the two magnetic plates and said wheel (Continued)

being partially arranged between the two magnetic plates, in an angular sector of the circular space that is left free by the electromagnetic transducer, so as to engage with the pinion. Advantageously, said wheel has a roller that is almost or entirely non-conductive and a non-magnetic staff.

10 Claims, 2 Drawing Sheets

(56) References Cited

U.S. PATENT DOCUMENTS

| | | | | |
|---|---|---|---|---|
| 3,816,779 | A * | 6/1974 | Lundin | G04C 13/10 310/37 |
| 4,387,312 | A * | 6/1983 | Oudet | G04C 13/11 310/268 |
| 6,469,959 | B1 | 10/2002 | Born | |
| 2004/0042349 | A1 | 3/2004 | Leuba et al. | |
| 2007/0025188 | A1 | 2/2007 | Leuba et al. | |

* cited by examiner

TIMEPIECE MOVEMENT FITTED WITH AN ELECTROMAGNETIC TRANSDUCER

This application claims priority from European patent application No. 17184880.7 filed on Aug. 4, 2017, the entire disclosure of which is hereby incorporated herein by reference.

TECHNICAL FIELD

The invention relates to timepiece movements comprising an electromagnetic transducer, in particular with a rotor bearing substantially axially polarized magnets on the side of the coil or coils of this electromagnetic transducer.

More specifically, the timepiece movement of the invention comprises an electromagnetic transducer formed by a stator and a rotor. The stator comprises at least one coil with a central axis that is parallel to the axis of rotation of the rotor. The rotor comprises a central shaft, two magnetic plates that are mounted on the central shaft and at least one magnet that is mounted on one of the two magnetic plates so as to be located between these two magnetic plates. Said at least one coil lies in a general plane, located between the two magnetic plates, axially remote from said at least one magnet, the rotor and said at least one coil being configured so that said at least one coil is located at least partially in a circular space which is defined by the rotor between its two magnetic plates from its central shaft to its periphery and which is left free by this rotor. The central shaft comprises a pinion which engages with a wheel of the timepiece movement.

In general, the invention relates to timepiece movements fitted with such an electromagnetic transducer forming either a continuous-rotation motor or a generator associated with a wheel train driven by a barrel.

TECHNOLOGICAL BACKGROUND

Several documents disclose timepiece movements fitted with an electromagnetic transducer of the type described above in the technical field of the invention. Several of these documents relate in a first instance to a generator, namely the patent CH 597 636, the international patent WO 00/63749 and the European patent applications EP 1 099 990 and EP 1 109 082. An older document, namely the certificate of addition FR 2.076.493 for a patent, relates to a continuous-rotation motor. All of the embodiments described in these documents envisage mechanically coupling the electromagnetic transducer with a wheel train of the timepiece movement via a pinion, arranged on the central shaft of the rotor above or below its two magnetic plates, interengaged with a wheel which lies in a plane located level with the pinion and hence higher or lower relative to the assembly formed by the two magnetic plates about the axis of rotation of the rotor. These embodiments result in the timepiece movement being at least as thick/high as the axial distance required for arranging the two magnetic plates in superposition, for a given magnet height and a given coil thickness, added to which is the height of the pinion and of the two guide bearings of the rotor. It should be noted that it is possible, in one advantageous variant, to decrease the bulk of the bearing located opposite the pinion by a slight amount in the way shown in FIG. 8 of the document EP 1 099 990, but not on the pinion side because of the presence of the wheel which in any case requires a certain additional height, as shown in this figure.

SUMMARY OF THE INVENTION

The object of the present invention is to provide a timepiece movement, fitted with an electromagnetic transducer of the type described above, which exhibits decreased thickness for a predetermined magnetic assembly of this electromagnetic transducer. The term "magnetic assembly" is understood here to mean the coil or coils forming the stator and the plurality of bipolar magnets that are mounted on the two magnetic plates.

To this end, the present invention relates to a timepiece movement such as specifically defined in the technical field discussed above and which is characterized in that the stator is configured so as to leave an angular sector of the circular space free, the aperture angle of which is selected to allow the aforementioned wheel to penetrate radially into this circular space up to the central shaft of the rotor while remaining in this angular sector; in that the pinion is arranged between the two magnetic plates and has at least one useful portion located between two geometric planes defining the circular space about the axis of rotation of the rotor; and in that said wheel is partially arranged between the two magnetic plates, in said angular sector of the circular space, so as to engage with the pinion.

By virtue of the features of the invention, it is possible to obtain a timepiece movement with decreased height/thickness. Specifically, the pinion and the wheel engaging with this pinion no longer require a certain specific height in addition to the magnetic elements of the rotor and the coils. In one advantageous variant in which the thickness of the coils is substantially equal to or greater than that of the roller of the wheel in question, the mechanical coupling of the electromagnetic transducer with a wheel train of the timepiece movement requires no additional height relative to that needed by the magnetic elements of the rotor.

BRIEF DESCRIPTION OF THE FIGURES

The invention will be described below in greater detail with the aid of the appended drawings, which are provided by way of nonlimiting examples, in which.

DETAILED DESCRIPTION OF THE INVENTION

Figure 1:
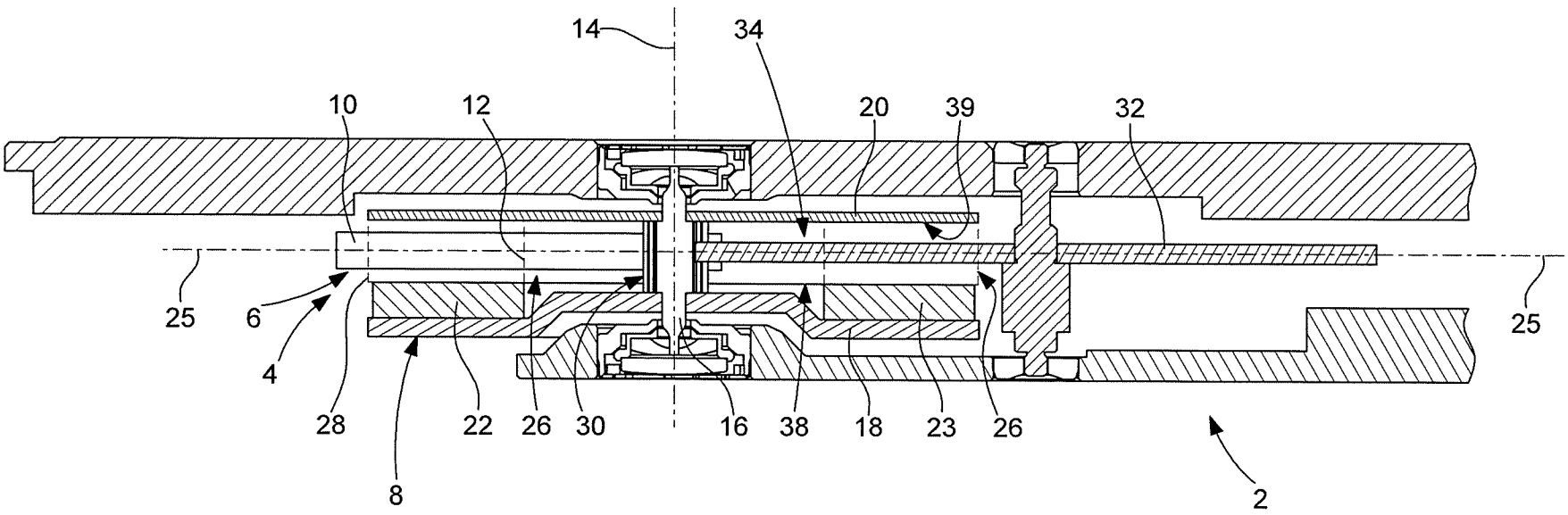
FIG. 1 is a view of a partial heightwise section, along the line I-I of FIG. 2, of a timepiece movement according to the invention.
Figure 2:
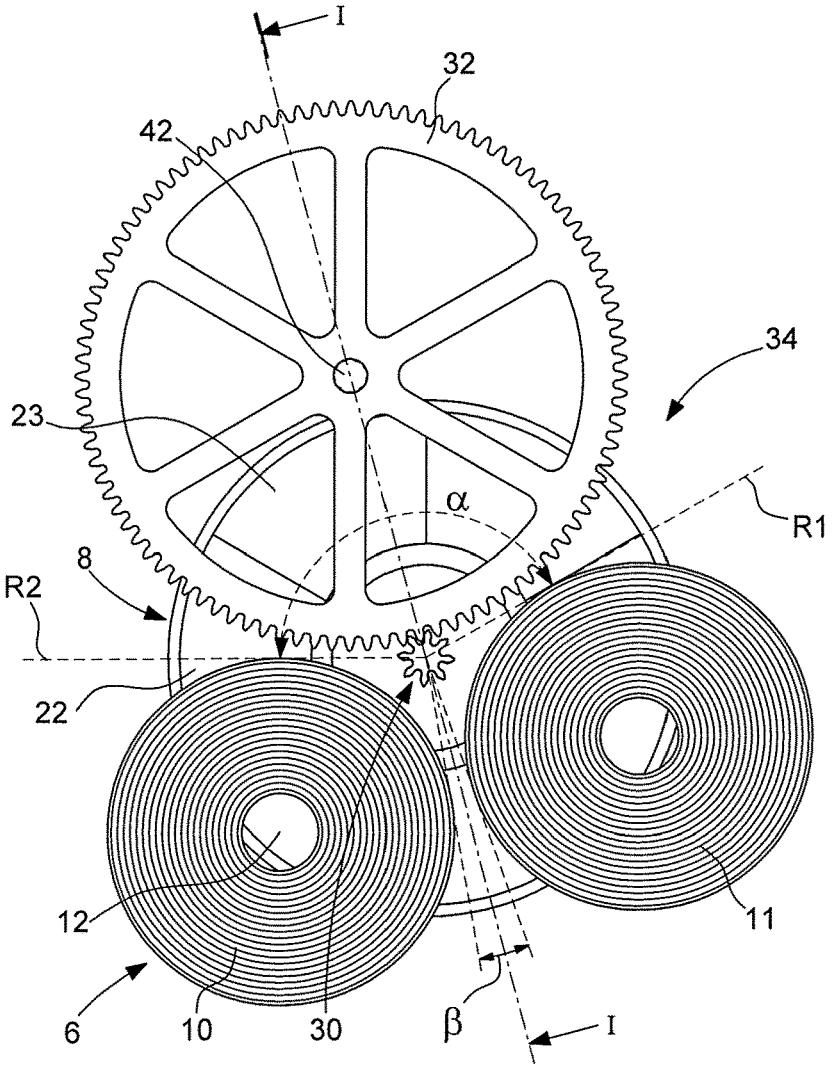
FIG. 2 is a partial view of a section of the movement of FIG. 1 along a plane that is perpendicular to the axis of rotation of the rotor of an electromagnetic transducer of the invention, this perpendicular plane being located between the coils and the upper magnetic plate of the rotor.
Figure 3:
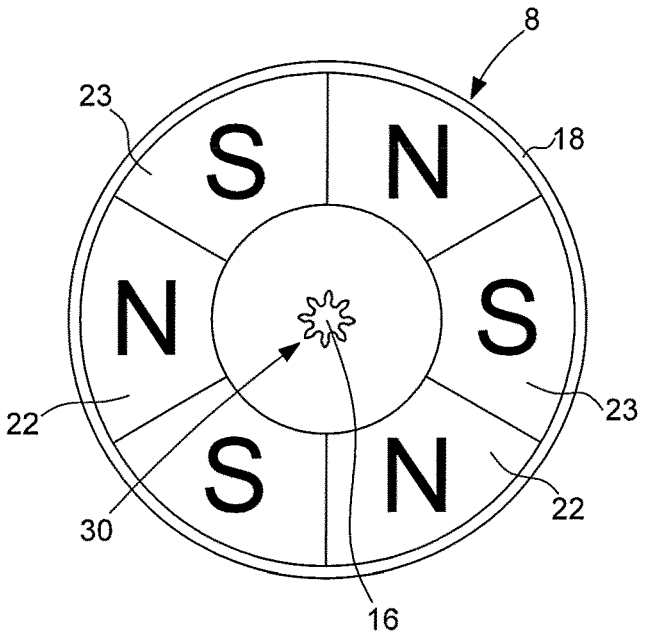
FIG. 3 is a sectional view of the rotor of FIGS. 1 and 2 along a plane that is perpendicular to its axis of rotation level with its pinion.

With reference to FIGS. 1 to 3, one embodiment of a timepiece movement according to the present invention will be described below:

The timepiece movement 2 comprises an electromagnetic transducer 4 formed by a stator 6 and a rotor 8. The stator comprises two coils 10 and 11, each having a central axis 12 which is parallel to the axis of rotation 14 of the rotor. The two coils are advantageously pancake coils, i.e. their thickness along their central axis is substantially less than their maximum dimension in a general plane that is perpendicular to this central axis. The coils shown take the shape of a flat disc. However, outlines other than a circular outline may be envisaged, in particular an ovoid or trapezoidal outline.

The rotor 8 comprises a central shaft 16, two magnetic plates 18 and 20 that are mounted on the central shaft and a plurality of bipolar magnets 22, 23 which are axially polarized and mounted on at least one of the two magnetic plates so as to be located between these two magnetic plates. In the variant shown, the plurality of magnets is arranged only on the lower magnetic plate 18 to which they are attached in particular by bonding. In this case, the upper magnetic plate 20 serves only as a plate for closing the field lines of the magnetic flux generated by the magnets. The two magnetic plates together form a shielding structure for the purpose of substantially confining the magnetic flux of the magnets within the volume defined by the rotor and a relatively small lateral volume at its periphery. In another variant, the bipolar magnets are shared equally between two magnetic plates. In this case, the magnets are aligned axially in pairs of magnets both having a polarity in the same direction so as to generate a substantially axial magnetic flux between them. The magnets are arranged with a given angular period on only one of the two magnetic plates or on both magnetic plates. In the variant shown, the polarities of the magnets alternate, which differentiates the magnets 22 from the magnets 23. It should be noted that although the bipolar magnets may be formed by distinct and initially mutually separate elements before their attachment to one of the two magnetic plates, these bipolar magnets may also be formed by an annular multipolar magnet having 2N magnetic poles forming axially magnetized pairs of poles, N being greater than 1. It should be noted that these variants are nonlimiting.

The two coils lie in a general plane 25, located between the two magnetic plates 18 and 20, axially remote from the plurality of magnets. The rotor and the two coils are configured so that these two coils are located partially in a circular space 26 which is defined by the rotor between its two magnetic plates from its central shaft 16 up to its periphery 28 and which is left free by this rotor. The central shaft comprises a pinion 30 which engages with a wheel 32 of a mechanism of the timepiece movement. According to the invention, the stator is configured so as to leave an angular sector 34 of the circular space 26 free, the aperture angle $\alpha$ of which is selected to allow the wheel 32 to penetrate radially into the circular space up to the central shaft 16 while remaining in this angular sector. It is noteworthy that the pinion 30 is arranged between the two magnetic plates 18 and 20 and has least one useful portion located between two geometric planes 38 and 39 defining the circular space about the axis of rotation 14. Thus, according to the invention, the wheel 32 is partially arranged between the two magnetic plates, in said angular sector of the circular space, so as to engage with the pinion 30. Preferably, the wheel 32 is configured and/or made of a specific material so as to decrease, or even eliminate, energy losses by Foucault current. Specifically, if the roller of the wheel is formed by a substantially flat disc made of a highly conductive metal material, the passage of the magnets of the rotor past this roller results in relatively substantial losses by Foucault current. If the roller has a plurality of apertures, in particularly substantially radial apertures or apertures defining empty angular sectors, such losses are decreased. By way of example, the roller of the wheel 32 has a hub and a rim linked by several substantially thin spokes. In one advantageous variant, the material forming the roller is an Inconel®-type metal alloy, the resistivity of which is much higher than that of brass. By using such a metal alloy, it is possible to envisage a substantially solid roller, i.e. a non-apertured disc. To completely eliminate the losses in question, the roller may be made of a synthetic material, for example polyoxymethylene (POM). In general, using a magnetic material for the roller of the wheel is to be avoided. The same applies for the staff of the wheel 32, so as to avoid the rotor exerting an attractive force on this axis. Specifically, in the opposite case, losses by friction will be generated at the bearings within which the wheel 32 pivots. The staff will for example be made using a copper-beryllium alloy or of a plastic material.

According to one advantageous variant, the wheel 32 lies in the general plane 25 of the two coils 10 and 11 with its axis 42 arranged at the periphery of the rotor. In particular, the aperture angle $\alpha$ of the angular sector 34 provided for this wheel is larger than 120°.

According to one advantageous variant, the sizes of the wheel 32 and of the two coils 10 and 11 are such that the angular areas between them have an angle at the centre $\beta$ that is smaller than 10°.

In a first embodiment of the invention, the electromagnetic transducer forms a continuous-rotation motor. In a second embodiment of the invention, the electromagnetic transducer forms a generator and the wheel 32 belongs to a wheel train that is interengaged with a barrel of the timepiece movement.

What is claimed is:

1. A timepiece movement comprising an electromagnetic transducer formed by a stator and a rotor, the stator comprising at least one coil with a central axis that is parallel to the axis of rotation of the rotor, the rotor comprising a central shaft, two magnetic plates that are mounted on the central shaft and at least one magnet that is mounted on one of the two magnetic plates so as to be located between these two magnetic plates, said at least one coil lying in a general plane, located between the two magnetic plates, axially remote from said at least one magnet, the rotor and said at least one coil being configured so that said at least one coil is located at least partially in a circular space which is defined by the rotor between its two magnetic plates from its central shaft to its periphery and which is left free by this rotor, said central shaft comprising a pinion which engages with a wheel of the timepiece movement;

wherein said stator is configured so as to leave an angular sector of said circular space free, the aperture angle of which is selected to allow said wheel to penetrate radially into said circular space up to said central shaft while remaining in this angular sector; wherein said pinion is arranged between the two magnetic plates and has at least one useful portion located between two geometric planes defining said circular space about said axis of rotation; and wherein said wheel is partially arranged between the two magnetic plates, in said angular sector of the circular space, so as to engage with said pinion.

2. The timepiece movement according to claim 1, wherein said at least one coil is a pancake coil.

3. The timepiece movement according to claim 2, wherein the stator comprises two pancake coils.

4. The timepiece movement according to claim 3, wherein said wheel lies in said general plane, said aperture angle is larger than 120° and the staff of the wheel is arranged at the periphery of the rotor.

5. The timepiece movement according to claim 4, wherein the sizes of said wheel and of the two coils are such that the angular areas between them have an angle at the centre that is smaller than 10°.

6. The timepiece movement according to claim 3, wherein the rotor comprises a plurality of bipolar magnets which are axially polarized and mounted according to a given angular period on at least one of the two magnetic plates.

7. The timepiece movement according to claim 3, wherein the electromagnetic transducer forms a continuous-rotation motor.

8. The timepiece movement according to claim 3, wherein the electromagnetic transducer forms a generator, said wheel belonging to a wheel train that is interengaged with a barrel of the timepiece movement.

9. The timepiece movement according to claim 1, wherein said wheel has a roller made of an Inconel®-type metal alloy or a synthetic material, in particular polyoxymethylene.

10. The timepiece movement according to claim 1, wherein said wheel has a staff made of a non-magnetic material, in particular a copper-beryllium alloy or a plastic material.

* * * * *